United States Patent [19]

Lippuner et al.

[11] Patent Number: 4,881,689

[45] Date of Patent: Nov. 21, 1989

[54] METHOD FOR SETTING THE GRINDING ROLLERS IN ROLLER FRAMES OF A FLOUR MILLING PLANT, AS WELL AS FLOUR MILLING PLANT FOR PERFORMING THE METHOD

[75] Inventors: Christian Lippuner, CH-9244 Niederuzwil; Werner Baltensperger, CH-9242 Oberuzwil, both of Switzerland

[73] Assignee: Gebrueder Buehler AG, Switzerland

[21] Appl. No.: 12,663

[22] PCT Filed: Mar. 5, 1986

[86] PCT No.: PCT/EP86/00112

§ 371 Date: Nov. 4, 1986

§ 102(e) Date: Nov. 4, 1986

[87] PCT Pub. No.: WO86/05416

PCT Pub. Date: Sep. 25, 1986

[30] Foreign Application Priority Data

Mar. 15, 1985 [CH] Switzerland ..... 01164/85
May 31, 1985 [DE] Fed. Rep. of Germany ..... 3519625

[51] Int. Cl.[4] ..... B02C 9/04; B02C 21/00
[52] U.S. Cl. ..... 241/9; 241/37
[58] Field of Search ..... 241/6, 13, 30, 34, 36, 241/37, 135, 143, 145

[56] References Cited

U.S. PATENT DOCUMENTS 3,716,196 2/1973 Motek et al. ..... 241/37 X
4,363,448 12/1982 Machler et al. ..... 241/37 X

FOREIGN PATENT DOCUMENTS 0013023 7/1980 European Pat. Off. .
2413956 9/1974 Fed. Rep. of Germany .

OTHER PUBLICATIONS

Die Muhle und Mischfuttertechnik, 9-85.

*Primary Examiner*—Mark Rosenbaum
*Attorney, Agent, or Firm*—Darby & Darby

[57] ABSTRACT

In a method for setting the spacings of grinding rollers (2, 2') in roller frames (1) of a cereal milling plant, the roller frames are in each case followed by a screening system (14), from which a test signal is tapped and supplied to a computer (7), which compares it with a stored desired value and in the case of a variation brings about an automatic adjustment of the spacings of the grinding rollers by means of a control signal and adjusting means (4, 5). The test signal is only derived from the screen reject material (17) or screenings (18) of screening system (14) and is only supplied from certain selected key passages to computer (7). In a cereal milling plant for performing this method, a momentum weight measuring system (24, 29, 30, 31) for the continuous determination of the sifting work is associated with the gyratory sifter or sifters (14).

16 Claims, 4 Drawing Sheets

METHOD FOR SETTING THE GRINDING ROLLERS IN ROLLER FRAMES OF A FLOUR MILLING PLANT, AS WELL AS FLOUR MILLING PLANT FOR PERFORMING THE METHOD

TECHNICAL FIELD

The present invention relates to a method for setting the spacings of grinding rollers in roller frames of a flour milling plant, each of the roller frames being followed by a screening system, from which is tapped a test signal which is supplied to a computer, which compares it with stored desired value and in the case of a divergence automatically adjusts the spacing of the grinding rollers by means of a control signal and adjusting means.

BACKGROUND OF THE INVENTION

For the control or adjustment of the grinding roller spacings in a flour milling plant at present essentially four solution proposals exist. The first and oldest solution proposal consists of regulating and controling the grinding rollers by the operator (miller). In order to be able to "manually" perform such a control operation, it is absolutely necessary to completely control the complete production sequence. The result of the control is largely dependent on the skill and experience of the operator, who is generally the miller. If it is necessary to use less skilled personnel, e.g. during special periods (holidays, night work, etc.), this can lead to less satisfactory results being obtained by the mill, e.g. through a smaller quantity of light flour being produced or the like.

A second control proposal is described in the journal "Die Mühle und Mischfuttertechnik" of Sept. 3, 1965. The essense of this known proposal is the use of trial screening. During production an absolute classification into the individual particle fractions is not sought, because this would lead to an excessively long screening time and would also cause modifications to the product quality. If e.g. the product being ground is subject for an excessively long period to a screening process, then the screenings also contain fine husks, which would normally float on the top of the material in gyratory sifter operation and would then be discharged as waste. In the case of the theoretical treatment of milling or grinding, it is not possible to take account of such fine points, because they are also dependent on the manner of operation of the preceding and following process machines, i.e. not only the milling per se. In the sense of a complete and absolute regulation of the milling work, it is therefore logical to subject the material being milled to a separate, precise laboratory screening and carry out corrections if variations occur. Although the proposed trial or test screening is more precise, it is not always possible to obtain a representative picture in practice, because the work of the gyratory sifter is, as stated, a combination of screening and sifting and requires a specific product layer over the screen mesh.

Another control possibility is described in EP-B1-13 023 and is based on the fact that any future development in the field of food processing should no longer fundamentally be directed at displacing humans. In fact many processes can be performed faster and less expensively by direct human intervention. Thus, the ever increasing knowledge of the almost complete interlinking of all processes increasingly requires human monitoring and control in cereal processing plants. It has been found that it is not worthwhile to have equipment perform all the processes which the human can monitor, check and manually control.

Another known theoretical proposal for controling a mill (DE-C-2 413 956) aims at replacing the operator, particularly the miller by computers and regulating means. It is based on incorporating the knowledge and experience of the miller in the computer programs and render any routine action on the part of the human superfluous by using independent regulating means. According to this proposal all the grinding rollers are set to a given grinding result on the basis of a previously worked out scheme, namely the ratio of material which does to that which does not pass through the screen. However, a corresponding practical realization of this proposal has not hitherto taken place.

On the basis of the latter prior art, the problem of the present invention is to so improve a control method of the aforementioned type that whilst greatly reducing expenditure an almost fully automatic operation is made possible, accompanied by operational reliability and without any rocking risk, as well as proposing a milling plant for performing such a method.

In the case of a method of the aforementioned type, this is achieved according to the invention in that the test signal is derived only from the screenings or rejected waste material of the screening system and is only supplied to the computer from certain selected key passages.

The measures according to the invention increase the ease of operation and the overall control is left in the hands of the miller. This makes it possible to avoid "oscillation" of the complete milling procedure, i.e. there are no rocking processes, which for many manipulations constitute a considerable hazard. The necessary number of interventions are kept to a minimum and are performed by an experienced person. One or more corrections for the preset control values can, according to the invention, only be performed within the framework of an overall survey, because centrally all the actual values, including those of the key passages, are available at all times and an intervention can be performed in a planned manner, without there being any need for any given fixed correction program. If a fault does occur, the major fault can be removed first, followed by the consequent faults. In the milling field it is considered that the milling as such must not be controlled by complicated regulating means. In connection with the milling of grain, it has not hitherto proved possible to bring all the effective parameters into theoretically or mathematically determinable forms. It is known that the same objective can often be achieved in different ways. It is often a question of the special experience of the miller and his knowledge of plant-specific data. Furthermore milling or grinding is the result of using corresponding groups of machines. The actual milling or grinding work is predetermined to a not insignificant extent by the machine designer, the nature of the operation and the maintenance to the machines, as well as the machines specifically used, the treatment diagram and the special features of the plant, so that there are limits to the way in which the miller can qualitatively influence the milling work.

A further complex which has not been paid much attention up to now is the question of quantitative milling work. It has been found that the quantitative milling work is a very important factor, particularly with a view to automation efforts. With respect to the qualitative evaluation, the human being with his sense and intuition is superior as compared automation tendencies through the use of machines, particularly with regards to milling intermediate products, but this does not apply with regards to the quantitative evaluation. The operator, such as the miller cannot be everywhere in the mill at the same time. The product flow therein is partly fixed by established preset values and largely the individual products automatically find their way into the product flow, the human acting in a regulating manner at certain important crossing points. However, by means of the information obtained at selected key passages according to the invention, an up to date picture of the complete process sequence is always available, even after interventions by the miller. The knowledge of the conditions at the key passages provides, together with the total output, conclusions as to what is happening on most of the machines requiring less extensive supervision. Thus, the invention constitutes a lucky chance with respect to the use of sensible automation, whilst still allowing intervention by the miller. The inventive method for the first time makes use of the surprising finding that when using test results from only a few selected key passages and their processing in a following computer, it is possible to achieve a largely automated control of the milling roller spacings in a cereal milling plant, without it being necessary to evaluate a vast number of other test results through corresponding complicated computing programs, because deliberately a residual intervention possibility on the part of the miller is planned in.

The invention permits various very advantageous development possibilities. At the B passage it is sufficient to e.g. simultaneously determine the mill input capacity, whilst at the C passages it is advantageous if the input capacity of each automatically monitored rolling frame is simultaneously determined. It is completely sufficient when there are very few product changes, if the test signal is determined during the milling process on the basis of the rejected waste material quantity of the first coarse flow ($B_1$ passage), preferably at short time intervals. In the case of frequent or very frequent changes to the raw material or end product quality, it is preferably to derive the test signal at passages $B_2$ and possibly further passages ($B_3$ etc.) on the basis of the screen reject or coarse flow quantity. In a particularly preferred manner, apart from the test signal derived from the screen reject or coarse flow quantity in the B passages, a further test signal is derived from the screenings or flour quantity at passages $C_1$, once again preferably at short intervals during the measuring or testing process and is supplied to the computer. As a function of the size and ease requirements at the milling or grinding passages, corresponding test values can be derived at the $C_2$ passages and possibly further passages selected in planned manner. In a particularly preferred manner, the test signal is derived from the quantity of the rejected material or screenings for the following passage combinations:

$B_1+C_1$ $B_1+B_2+C_1$ $B_1+B_2+B_3+C_1+C_2$ $B_1+B_4+C_1+C_4$.

The latter combination for deriving the measured value is based on the idea that with passages $B_1$ and $C_1$ a regulating process is ensured, whereas passages $B_4$ and $C_4$ serve for control or checking purposes only. Only particularly preferred combinations for deriving the test signal at particularly important test points are given, but they can be chosen and used by the Expert as a function of the particular milling plant.

According to a further preferred development of the inventive method, the computer stores for each cereal mixture or for each milling function a preset value — desired value diagram containing all the values for the automatic control of the grinding roller spacings, particularly the preset values corresponding to the grinding gap, together with the minimum and maximum values for the coarse material or flour valid for the subsequently determined gyratory sifter and within which no desired values for the rolling frames are to be changed. This avoids an undesired, overfrequent correction of the roller settings. Thus, at least in theory, a single grinding gap correction at the first coarse material roller frame in a large milling plant leads to change in the conditions at the following twenty to thirty rolling frames and gyratory sifters. Thus, preferably a correction program is associated with the computer, which automatically carries out correction instructions by modifying the operating desired values in the order from the largest to the smallest correction. Thus, if a considerable variation is established at selection passage $C_1$, then this is corrected first, followed e.g. by the necessary following correction at passage $B_1$, etc.

It is also very advantageous if the computer contains a basic program, which includes non-automatically detected parameters, (such as e.g. the grinding pressure, power absorption, effective grinding gap width, etc.), particularly also those of non-automatically controlled machines (i.e. non-automatic adjustable or regulatable rolling frames and derived values with respect to the screening work) and can be polled at any time in such a way that, based on earlier values, it is possible to carry out checks and corresponding interventions. This solution makes particularly obvious the usefulness of the automatic means for all the necessary checks and manipulations. It also leads to the advantage that for every shift in a mill, the miller can make use of earlier values. This also makes it possible to ensure a relatively constant operational control of the milling plant, even in the case of personnel changes. It is sufficient in most cases if automatic presetting of the grinding gap only takes place on some of the rolling mills and only on part of said automatically preset rolling mills is a measurement made of the material which does and/or does not pass through the screen, from which the test signal is derived. Thus, preferably only in the case of part of all the rolling mills is there an automatic presetting of the grinding gap and only in part of the automatically presettable rolling mills is the material which does/does not pass through the screen measured can the test signal derive therefrom, so that preferably in less than half of all the rolling mills is the grinding gap automatically preset and in two to six following gyratory sifters is there a measurement of the material which does or does not pass through the screen and the derivation of a test signal therefrom.

According to a particularly advantageous further development of the inventive method, the test signal is derived from instantaneous values of the force fractions, as well as the inflow momentum of the product flow, together with the weight thereof in a weighing vessel, the screenings and/or screen rejection material during continuous operation by determining said instantaneous values over a short period of time, a control quantity is derived therefrom, used for automatic monitoring is optionally used for controlling the rolling frames. It is remarkable that clearly all earlier tests based on continuously operating momentum measuring systems failed. In such continuous weighing systems conclusions are drawn regarding the product quantity on the basis of the momentum of a falling product flow, which leads to relatively good results under ideal conditions. However, if disturbing quantities occur, e.g. the flour starts to stick to the baffle plates, the measured value is rapidly falsified to such an extent that it becomes unusable. Account can easily be taken of this problem in the inventive method, in that by a simple subtraction of two shortly following measurements in a weighing container, the momentum part and therefore any problem source such as atmospheric humidity, product sticking, etc. can be obviated. However, this momentum measurement requires a continuous inflow of material into the weighing container, so that the measurement can be termed continuous. If the aim is an improvement to the uniformity of the product flow in the milling plant, then the value of an intermediate weighing, which is substantially continuous, is frequently performed and only takes a short time. The use of a measured value (as in conventional methods), which in itself represents a disturbance quantity and whose avoidance was the object of the measurement and regulation used, is pointless, as has been demonstrated in the past. According to an advantageous further development of the inventive method for the purpose of determining the control quantity, the weight increase in the weighing vessel is determined without interrupting the product flow per unit of time, the determined value is compared with the complete mill capacity and as a parameter for the sifting unit is then supplied to the computer. Weighting is then preferably carried out in the weighing vessel according to a predetermined cycle, preferably every ten to thirty minutes and it lasts less than 10 seconds, preferably less than 5 seconds.

The invention also aims at a cereal milling plant with a sequence of rolling frames and gyratory sifters, in which the grinding rollers have setting means with controllable drive means and the gyratory sifters are followed by a weighing system for automatically determining the sifting work, whilst a central computer with data store is provided for setting and monitoring the grinding roller setting according to preset desired values and in particular for performing the inventive method. According to the invention this cereal milling plant is characterized in that a momentum weight measuring system for continuously determining the sifting work is associated with the gyratory sifter or sifters. The measured values obtained can, without any disturbing quantity being obtained from the product characteristics, be determined with the precision of balance measured values and nevertheless the advantage of a continuous measuring process, much as with a conveyor-type weigher is obtained. The essential difference compared with the conveyor-type weigher is the very simple construction and the correspondingly low manufacturing costs, such as can otherwise only be obtained with the much more fault-prone momentum measuring means. The inventive milling plant has a number of advantages encountered in conveyor-type weighers and continuous flowmeters, but without having their disadvantages.

Preferably the grinding rollers can be controlled or regulated by means of the computer on the basis of an actual - desired value comparison for the purpose of setting or regulating corresponding operating parameters (grinding roller speed and/or grinding gap) adjustable by means of the grinding rollers. Once again, the setting means or their drive means are preferably remotely controllable by a central computer and there is mechanical or electric coupling between the drive means and the setting means. This solution is preferably used at grinding passages, i.e. on smooth rollers. In the case of coarse material passages or with grooved rollers, the setting means or the drive means for the same is preferably remotely controlled by the computer and is provided for preventing harmful controls with a pressure or distance or force absorption limiting device.

SHORT DESCRIPTION OF THE DRAWINGS

The invention is described in greater detail hereinafter relative to the drawings, wherein show:

FIG. 1 — A diagrammatic view of an inventive apparatus for automatically monitoring the grinding roller pair.

FIG. 2 — A greatly simplified representation of the monitoring of the grinding and sifting work of a complete milling plant.

FIG. 3 — A diagrammatic representation of certain coarse material and grit passages with their starting products.

FIG. 4 — A diagrammatic representation of various milling passages.

DETAILED DESCRIPTION OF THE DRAWINGS

Figure 1:
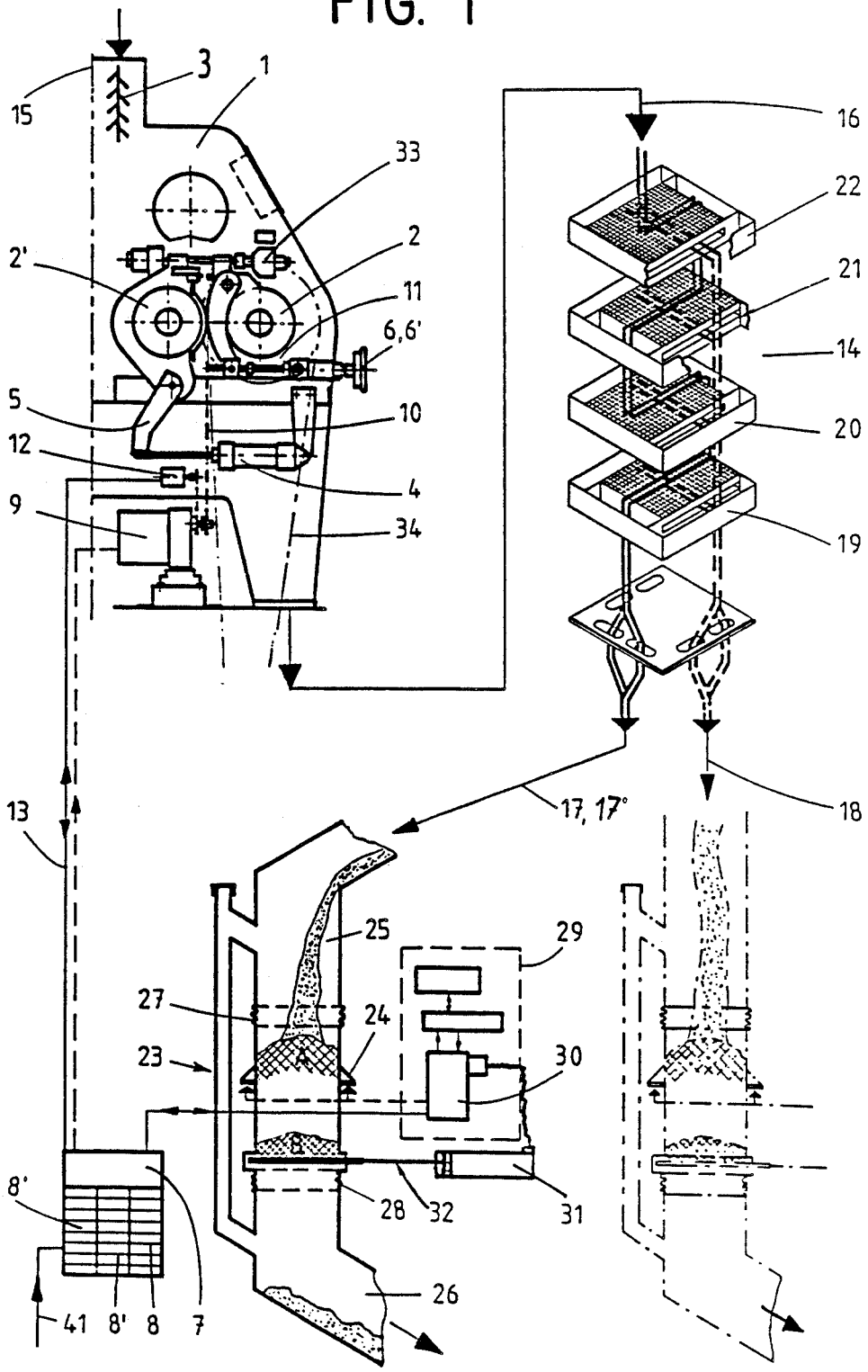

FIG. 1 shows a rolling frame 1, whereof only half or a single grinding roller pair 2, 2' is shown. A special feature of the rolling frame used in milling is that other than with products such as rock or coal, the product is not crushed and also not purely squeezed. In fact a pressure — shearing process takes place and this is achieved by increasing the rotational speed of one roller, e.g. roller 2' compared with the rotational speed of the other roller, e.g. roller 2. Thus, grinding rollers 2, 2' may only be engaged when product is present and this can be established or controlled by means of a product sensing device 3. Via a corresponding signal a pneumatic piston and via the latter a lever and consequently the associated roller 2' is brought into its engaged or disengaged position. The grinding gap can be preset to a desired amount by means of a handwheel 6 or, if necessary, can subsequently be corrected by the operator. However, independently of this, the grinding gap can also be remotely controlled from a computer 7 with desired value memories 8, 8', 8''. As described e.g. in EP-B1 0 013 023, the grinding gap can be automatically set to a given optimum value based on earlier milling operations in the sense of a coarse setting using a shifting motor 9 and a chain 10 acting on shaft 11 of handwheel 6. An in each case identical value for the measurement of the grinding gap is established by means of a production indicator 12 carried with chain 10 and supplied back to computer 7 by a control line 13.

In FIG. 1 a gyratory sifter 14 is shown at the top right. The product flow as the input capacity into the rolling frame 1 is indicated by an arrow 15, whilst arrow 16 indicates the product transfer from rolling frame 1 to gyratory sifter 14, arrow 17 indicates the screen reject material and arrow 18 the screenings. The gyratory sifter 14 is provided with individual screening frames 19, 20, 21, 22, whose number is a function of the product capacity and in particular the product quality.

FIG. 1 shows the determination of the product throughput as a function of the screen reject material (arrow 17) in a control circuit using continuous lines. By means of elastic sleeves 27, 28, a weighing vessel 23 is mounted separately from the fixed plant components, whilst there is also an inlet 25 and an outlet 26. Weighing vessel 23 is supported on electronic balance means 24, which transfer the weight signals as test signals to a control means 29. A converter 30 supplies a pneumatic signal to a cylinder 31, which operates a closure slide 32. The weighing system is described in greater detail in the aforementioned EP-B1-0 013 023 and full reference is made thereto. By means of this system a weight increase per unit of time is measured e.g. during a fraction of a second up to several seconds and a derived test signal for the weight/time unit ratio is supplied to computer 7. In this novel system, it is decisive that the product supply 17' to weighing vessel 13 is not interrupted during, before or after the measurement. With regards to the weight increase, electronic balance means 24 measure instantaneous values at time intervals, e.g. the product quantity A (following a certain delay after the closure of slide 32) and product quantity B in weighing vessel 23. The fill height difference between product quantities A and B then precisely corresponds to the product quantity, which has flown into the container from a time associated with product quantity B to the time associated with product quantity A and then a corresponding signal for the product throughput can be derived therefrom. All the necessary data (such as e.g. the input capacity 15, product mixture and specific preset grinding information) are fed into computer 7 and kept available in the corresponding memories 8, 8' and 8''.

The plant operates as follows. In accordance with the grinding or milling work to be carried out, the corresponding storage locations in memories 8, 8', 8'' are polled by a central computer 40 (FIG. 2) via a control line 41 and the data are made available to the computer. Essential data are the values for the cereal mixture and moisture, for the milling work and for the input capacity, as well as the associated values for the rolling frame, grinding gap, grinding pressure or electric power consumption of the rolling frame drive motor. FIG. 1 symbolically shows a pressure meter 33 and an ammeter 34. The grinding roller spacing can be derived directly from the measured value of position indicator 12 or, in the case of a corresponding reading 6' of handwheel 6 can be read off. The next most important value is now the determination of a corresponding test value on the gyratory sifter, e.g. in FIG. 1 the weight quantity per unit of time with respect to the screen reject material, which is e.g. for the first coarse material passage chosen as the preferred key passage. For simplifying the representation for the indicated example, the measured value of position indicator 12 (therefore a value corresponding to the grinding roller spacing) is called the "roller spacing". A measurement also takes place of the product quantity per unit of time of the first screen reject material or the in each case instantaneous or averaged capacity of the second coarse flow or $B_2$, followed by a corresponding comparison. For the regulation or control to be performed, no interest is attached to the absolute roller spacing value, because a corresponding numerical value can be determined from the preceding optimizations, but the precise value for the amount of coarse material produced $B_2$ is very important. If all the process parameters are found to be correct (moistening of the cereal, cereal standing time, mill input capacity, etc.), experience has shown that the mill still does not operate fully automatically with constant milling work and constant milling quality, because the product to be milled (cereal) is a "living" material, which is constantly subject to influences as a result of its origin and climatic conditions, or as a function of its growth phase. The wheat grain breathes, produces starch, the protein changes, so that there are various very complex enzymatic and other processes. This not only influences the mechanical processability, but also the water absorption behaviour and strength characteristics of the husks and the actual flower. Thus, it is the objective of good milling to obtain a high yield of light flour with optimum qualities, whilst utilizing the milling plant in an economically advantageous manner. Even though the miller must ultimately control the mill himself, in the case of large plants (only and especially in these) control means are indispensable, so that one person is in a position to effectively manage a complete milling plant and obtain the necessary overall picture thereof, which is the main objective of the invention.

For controlling the milling work, continuously the values from one or more key passages or the selected screen rejected material or screenings, as well as one or more important further measured values are taken from the production sequence and monitored. If e.g. the screen reject proportion for the first coarse material is 70 to 75% of the mill input capacity, this indicates to the miller that the processing has been satisfactory up to the corresponding point. The control system can be such that for the screen value a close tolerance band is chosen for each individual milling function and for each individual milling passage, within which the milling sequence is satisfactory, which can e.g. be indicated by means of a corresponding control lamp. There is also a second, larger tolerance band, within which the computer directly initiates a change to the grinding gap and following a corresponding time delay is retained if the correction is successful. However, if a screen value is measured which is outside the broader tolerance band, e.g. an alarm can be given or the rolling frame can be completely stopped.

Figure 2:
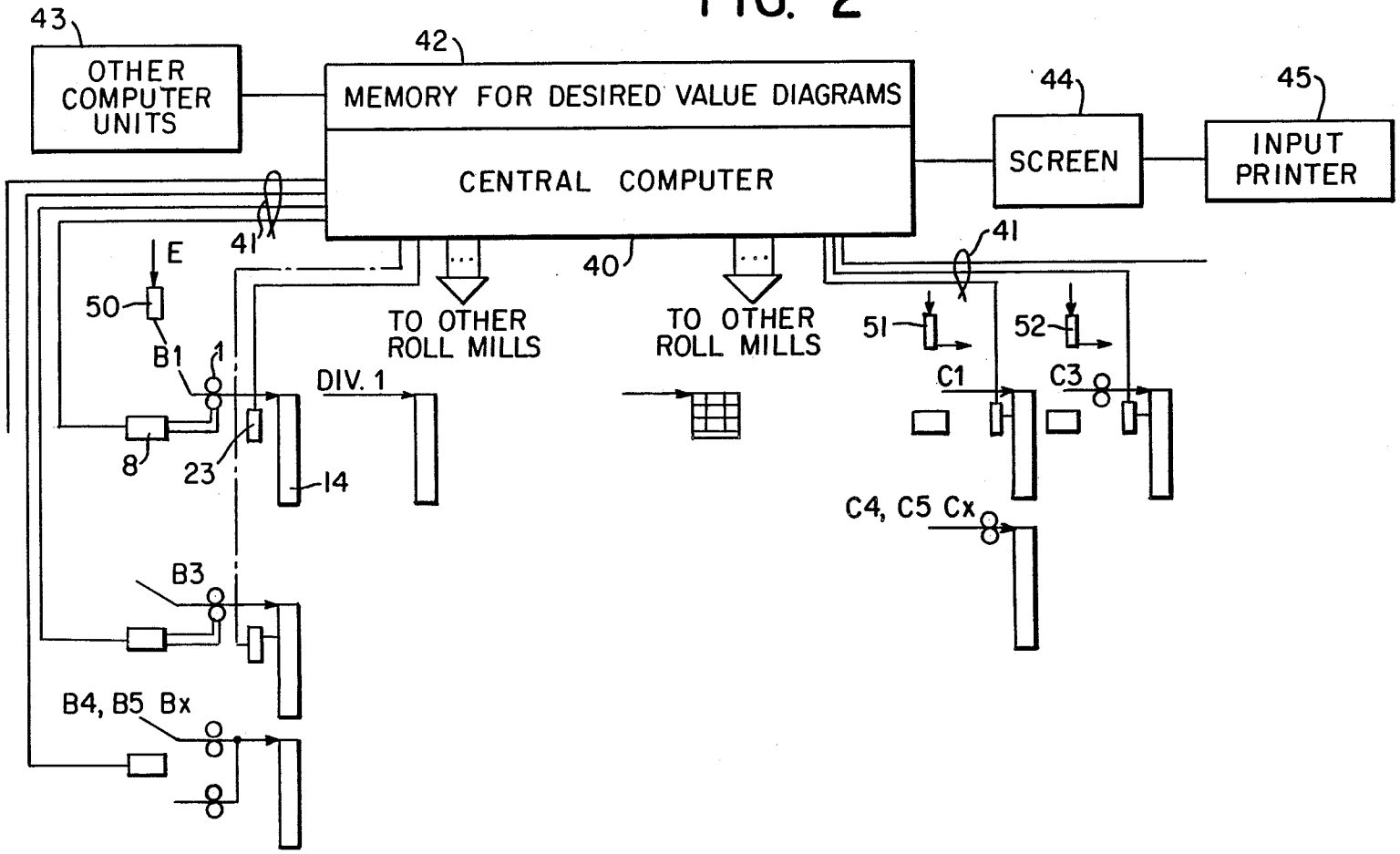

As each mill has to satisfy specific requirements and also has a special diagram of the operating sequence, a plurality of sensible use possibilities is provided. FIG. 2 constitutes the basic diagram, only certain examples of the possible processing machine being shown, even though in practice there are numerous such machines.

The central computer 40 has a memory 42 for the desired value diagrams and can also be connected to other computer units 43, e.g. to an accounting computer. As a function of the upgrading of the plant, the computer can be equipped with a central screen 44, as well as a central input printer 45. In its complete upgrading stage, there are preferably one or more transportable screens with input printers, which can be used at the work point for local interventions, e.g. at a grinding frame or the like. For simplification purposes in FIG. 2, only at the first milling passage $B_1$ are the same references used as in FIG. 1, although the corresponding identical elements can be used at any random point within the mill, such as at $B_2$, $B_3$ or $B_x$ as well as $C_1$, $C_2$, $C_3$. . . $C_x$. Only some of the passages are fully monitored, namely in FIG. 2 passages $B_1$ and $B_3$ as well as $C_1$ and $C_3$. Furthermore, a further proportion of the grinding frames are provided with an automatic grinding gap control means with computer, but without weighing system, this applying to passage $B_x$ in FIG. 2. Furthermore, for many passages, there is neither an automatic control of the grinding frames, nor a weighing of the screen reject material or screenings, designated Div.1 and $C_x$ in FIG. 2. Generally, at most passages, there is no mechanical monitoring in the sense of the invention, but it is obvious that at all drive motors of the rolling frames power consumption is measured and monitored.

Figure 3:
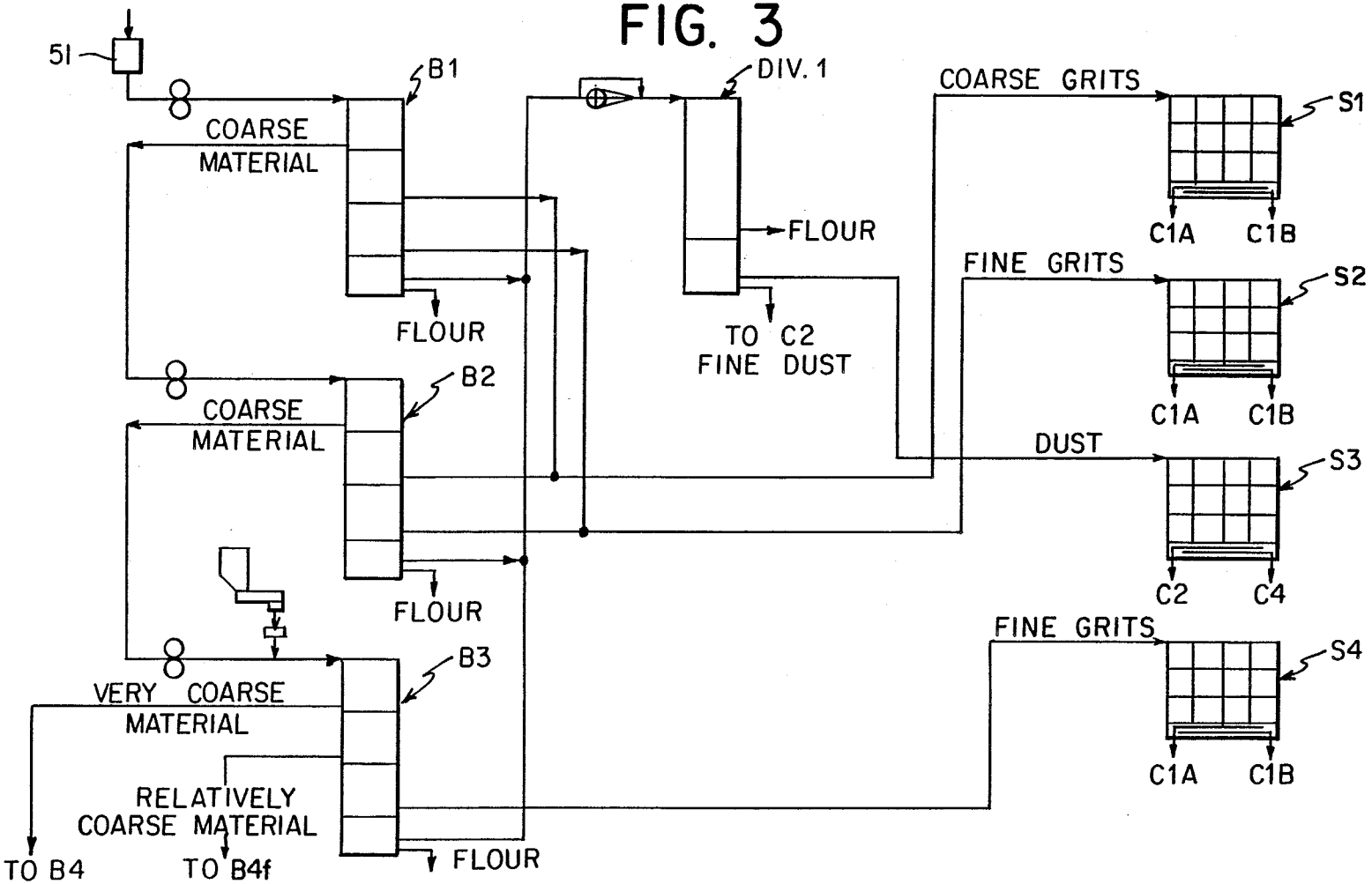
Figure 4:
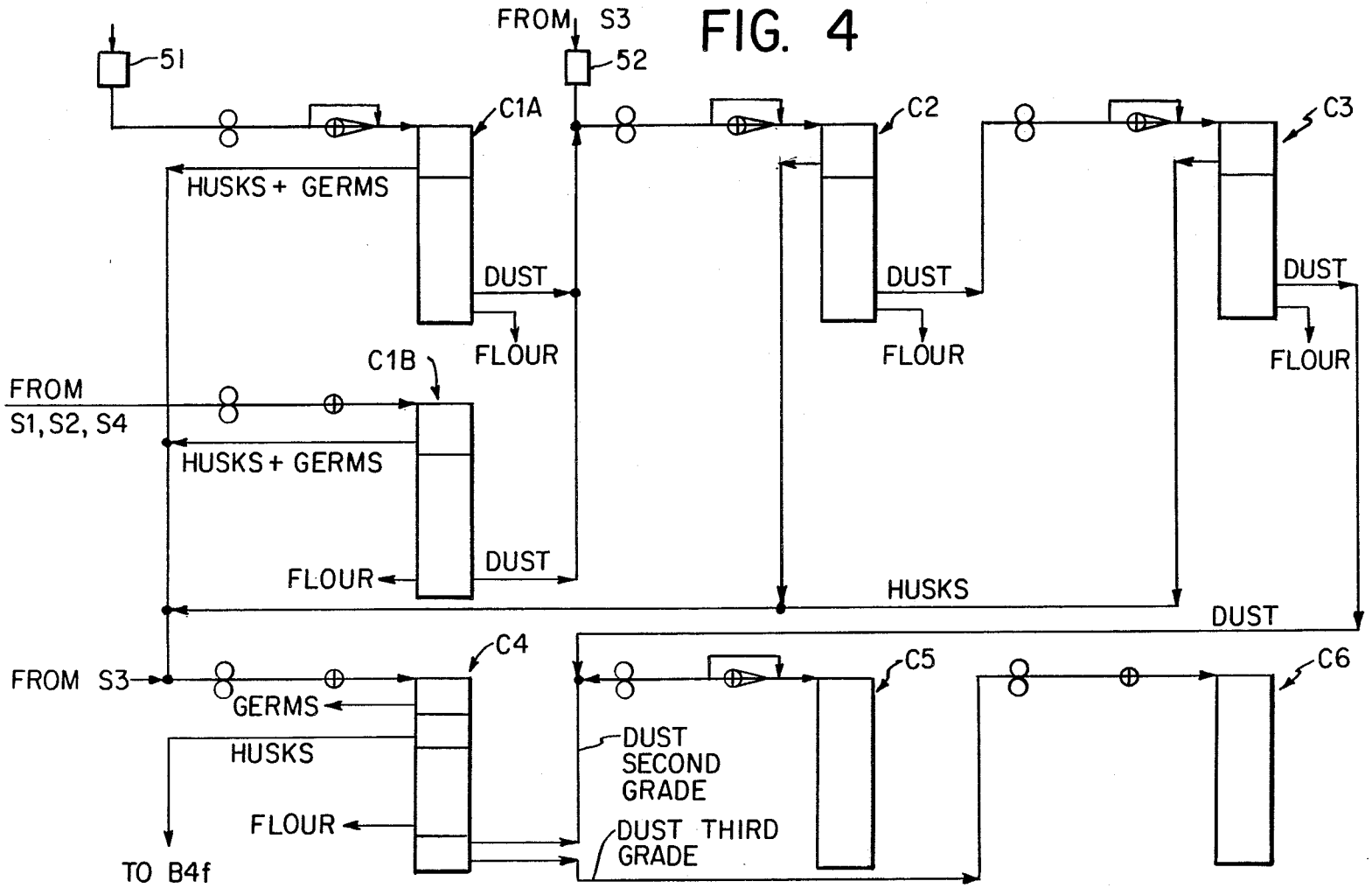

FIGS. 3 and 4 merely represent larger scale views of FIG. 2, the diagrammatic links being apparent. Passages B represent the start of milling, S the grits polishing machines and C the milling passages. Div.1 stands for a divisor.

It is important that in all cases the mill input capacity, i.e. the quantity of raw cereal to be processed is precisely determined throughout the milling operation, e.g. by a weighing system designated 50 at $B_1$. As the milling passages are supplied from different points, at C passages, it is necessary to have a measurement of the input capacity at least at $C_1A$ by a device 51, as well as at $B_2$, $C_2$ by a device 52.

We claim:

1. In a method for setting spacings of grinding rollers in rolling frames of a cereal milling plant, the rolling frames being followed by a screening system, from which is tapped a test signal and supplied to a computer, which compares it with a stored desired value and, in the case of a difference, by means of a control signal and adjusting means, automatically adjusts the spacings of the grinding rollers, the improvement comprising deriving the test signal only from the material which passes through the screening system or from the material which does not pass through the screening system and supplying the test signal only from certain selected key passages of the screening system to the computer.

2. A method according to claim 1, characterized in that the test signal is derived from one of the screen reject material and a coarse material quantity at at least one of predefined passages $B_1$, $B_2$ and $B_3$.

3. A method according to claim 1, characterized in that the test signal is derived from one of the screenings and a flour quantity at at least one of predefined passages $C_1$, $C_2$ and $C_3$.

4. A method according to claim 1, characterized in that a preset value — desired value diagram is stored in the computer for each cereal mixture or for each milling function, in which are given all the values for the automatic control of the grinding roller spacings, particularly the grinding gap preset values, as well as minimum and maximum values for the coarse material or flour quantity produced valid for following gyratory sifters and within which no rolling frame desired values are changed.

5. A method according to claim 4, characterized in that a correction program is associated with the computer and this automatically performs correction instructions by modifying the operating desired values in the order largest to smallest correction.

6. A method according to claim 1, characterized in that the computer contains a basic program, which also covers non-automatically determined parameters, including those of non-automatically controlled machines and can be polled at all times, the test signal earlier values being used to carry out checks and corresponding interventions.

7. A method according to claim 1, characterized in that the grinding roller spacing is only automatically preset for some of the rolling frames and subsequently at least one of the screen reject material and screenings are measured for only some of the rolling frames which are automatically presettable.

8. A method according to claim 7, characterized in that, in less than half of all rolling mills, the grinding gap is automatically preset and either the material which passes or the material that does not pass through the screen is measured at 2 to 6 following gyratory sifters.

9. A method according to claim 1, wherein the test signal is derived from instantaneous values of: (i) force fractions, (ii) the inflow momentum of the product flow, (iii) the weight thereof in a weighing vessel, and (iv) the amount of at least one of the material which passes through the screen and the material which does not pass through the screen during continuous operation, by determining said instantaneous values over a short period of time, a control quantity derived therefrom and being used for automatically monitoring and optionally controlling the rolling frames.

10. A method according to claim 9, characterized in that for determining the control quantity, the weight increase in the weighing vessel per unit of time is determined without interrupting the product flow, the test signal is compared with the overall mill capacity and is then fed into the computer as a parameter for a sifting unit.

11. A method according to claim 9, characterized in that weighing according to a predetermined cycle is carried out in the weighing vessel and lasts less than 10 seconds.

12. A method according to claim 9, characterized in that weighing according to a predetermined cycle is carried out in the weighing vessel and lasts less than 5 seconds.

13. A cereal milling plant with a sequence of rolling frames and gyratory sifters, the rolling frames having grinding rollers having adjusting devices with controllable drive means and a weighing system for the automatic determination of the sifting work is connected downstream of at least one gyratory sifter at a predefined key location and with a central computer with data store for setting and monitoring the grinding roller setting in accordance with preset desired values, characterized in that a weight measuring system for the continuous determination of the sifting work is associated with the at least one gyratory sifter and is coupled to receive only material which passes through the sifter or only material which does not pass through the sifter.

14. A cereal milling plant according to claim 13, characterized in that the grinding rollers can be controlled by means of the computer as a result of an actual — desired value comparison for setting or regulating corresponding operating parameters adjustable by means of the grinding rollers.

15. A cereal milling plant according to claim 13, characterized in that one of the setting means or the drive means therefore are remotely controllable from a central computer and the drive means and the setting means are coupled together.

16. A cereal milling plant according to claim 13, characterized in that one of the setting means or the drive means therefore are remotely controllable by means of the computer and equipped with one of a pressure, distance and force absorption limiting device for preventing harmful controls.

* * * * *